US007306391B1

(12) United States Patent
Spreier

(10) Patent No.: US 7,306,391 B1
(45) Date of Patent: Dec. 11, 2007

(54) SPATULA PEN

(76) Inventor: Mitchell Paul Spreier, 1154 E. Carolina, Unit 1, Fruita, CO (US) 81521

( * ) Notice: Subject to any disclaimer, the term of this patent is extended or adjusted under 35 U.S.C. 154(b) by 0 days.

(21) Appl. No.: 10/952,617

(22) Filed: Sep. 29, 2004

(51) Int. Cl.
*B43K 29/00* (2006.01)

(52) U.S. Cl. ..... 401/195

(58) Field of Classification Search ..... 401/37, 401/38, 52, 195; 7/118, 158, 160
See application file for complete search history.

(56) References Cited

U.S. PATENT DOCUMENTS

| | | | | | |
|---|---|---|---|---|---|
| 854,227 | A | * | 5/1907 | Luther | 401/222 |
| 949,085 | A | | 2/1910 | McBride | |
| 1,085,779 | A | | 2/1914 | Zohm | |
| 1,124,651 | A | | 1/1915 | Peterson | |
| 1,368,944 | A | | 2/1921 | Kurose | |
| 1,441,103 | A | | 1/1923 | McGinnis | |
| 1,444,155 | A | | 2/1923 | Jorgensen | |
| D79,889 | S | | 11/1929 | Madhn | |
| D91,976 | S | | 4/1934 | Deli | |
| 2,110,999 | A | | 3/1938 | Miga | |
| 2,141,061 | A | * | 12/1938 | Dodson | 30/162 |
| D134,010 | S | | 10/1942 | Weiss | |
| D138,875 | S | | 9/1944 | Weiss | |
| D152,847 | S | | 2/1949 | Weiss | |
| 2,841,156 | A | | 7/1958 | Herald | |
| D189,772 | S | | 2/1961 | Serin | |
| D192,309 | S | | 2/1962 | Russ | |
| 3,228,378 | A | | 1/1966 | Rohrmuller | |
| 3,846,927 | A | * | 11/1974 | Geffen | 40/334 |
| 4,602,397 | A | | 7/1986 | Chao | |
| 4,678,206 | A | * | 7/1987 | Leahan | 281/44 |
| D300,833 | S | * | 4/1989 | McShirley | D19/46 |
| D397,147 | S | | 8/1998 | Mackenzie | |
| 5,984,558 | A | * | 11/1999 | Diep | 401/195 |
| D450,086 | S | | 11/2001 | Rosenbaum | |

* cited by examiner

*Primary Examiner*—David J. Walczak
(74) *Attorney, Agent, or Firm*—Henry L. Smith, Jr.

(57) ABSTRACT

A combination of spatula and writing instrument of special use and synergy to pharmacists for sorting, counting and manipulating pills and capsules, and for mixing materials for prescriptions.

5 Claims, 3 Drawing Sheets

SPATULA PEN

CROSS REFERENCE TO RELATED APPLICATIONS

None

STATEMENT REGARDING FEDERALLY SPONSORED RESEARCH AND DEVELOPMENT

None

BACKGROUND

1. Field of Invention

The field of the Invention is the field of writing instruments and spatulas used by pharmacists to count, sort or manipulate pills, capsules, to mix prescriptions, etc.

2. Description of Prior Art

Over the years a number of inventions have involved a combination of a pen or other writing instrument with some other tool. However, the Inventor is unaware of any prior art which combines a pen or other writing instrument with a spatula suitable for use by a pharmacist. Representative of the prior art are the following patents. Design Pat. 397,147, Aug. 18, 1998, to Mackenzie, discloses a combination pen and retractable knife blade. U.S. Pat. No. 3,228,378, Jul. 6, 1964, to Rohrmuller, discloses a combination writing instrument and manicure device. Several design patents including Design Pat. 91,976, Apr. 10, 1934, to Deli, disclose a combination of writing instruments and letter openers. However, the shape of the blade of the letter opener or its sharp surface, and the handle portion and writing instrument portion of these inventions differ substantially from the present Invention.

SUMMARY OF INVENTION

The Invention is a combination of a ballpoint pen or other writing instrument and a spatula or blade for sorting counting or manipulating pills or capsules, or for mixing materials for custom prescriptions. The two parts of the device have a special synergy for pharmacists because pharmacists often need both functions in one instrument for speed and efficiency of use. The Invention can almost instantly be switched from one function to the other.

OBJECTS AND ADVANTAGES

The objects and advantages of the present Invention are:

1. To provide a device for pharmacists for quickly switching between a spatula and a writing instrument.

2. To provide one device which can be kept in a pharmacist's pocket which will perform both writing and pill sorting functions.

3. To provide a device of special usefulness for pharmacists which is inexpensive to manufacture.

4. To provide an instrument for pharmacists which will avoid the necessity for looking for a writing instrument when the pharmacist is using a spatula to manipulate pills or capsules, and vice versa.

5. To provide a device performing two essential functions for a pharmacist which is very lightweight.

6. To increase the efficiency of pharmacists' work by enabling them to quickly switch between a pill manipulating instrument and a writing instrument.

7. To provide an instrument which is sized and shaped so as to enable a pharmacist by the flick of the hand to switch between a spatula and writing instrument.

8. To provide a flexible spatula blade for cleaning up powder or broken pieces of capsules, or pills.

9. To provide a spatula with flexible blade shaped for mixing powders, creams, pastes, etc. for prescriptions.

10. To greatly reduce the number of pens within a pharmacy.

11. When used for compounding or mixing custom prescriptions, the pharmacist can instantly record measurements and formulas by switching from blade to pen.

DRAWING FIGURES

REFERENCE NUMERALS IN DRAWINGS

Figure 1:
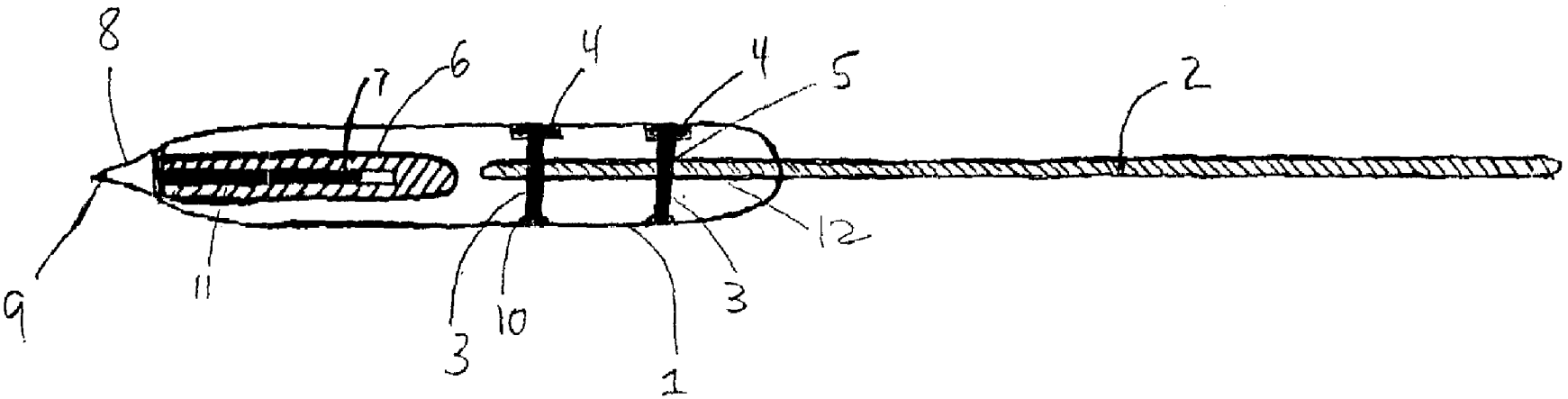
FIG. 1 is a side cross sectional view of the Invention, with the section taken through the blade and handle in the plane defined by the two screws, showing the edge of the blade and the pen chamber in the handle containing the pen refill tube.

1. handle
2. blade
3. screw
4. nut
5. blade hole
6. pen chamber
7. pen refill tube
8. pen tip fitting
9. pen tip
10. screw head
11. ink
12. handle slit
13. band

DETAILED DESCRIPTION OF THE DRAWINGS

FIG. 1 shows a side view of the Invention including a side view of blade 2. This view is a cross section taken along the plane determined by the two screws 3. Also shown in the drawing is the pen chamber 6 containing the pen refill tube 7 containing ink 11. Two screws 3 are shown extending through cylindrical holes in handle 1. Detail of the holes are obvious and are not shown. The screw heads 10 may be beneath the surface of handle 1 in small recesses designed to receive them. The screws 3 penetrate two holes 5 in blade 2 and engage corresponding nuts 4 which also may be made flush with the outside surface of handle 1 by means of small depressions in handle 1. The blade 2 is positioned in handle slit 12, in a manner similar to the construction of many common knives. At the left end of the Figure is shown pen tip fitting 8, through which pen tip 9 protrudes.

Figure 2:
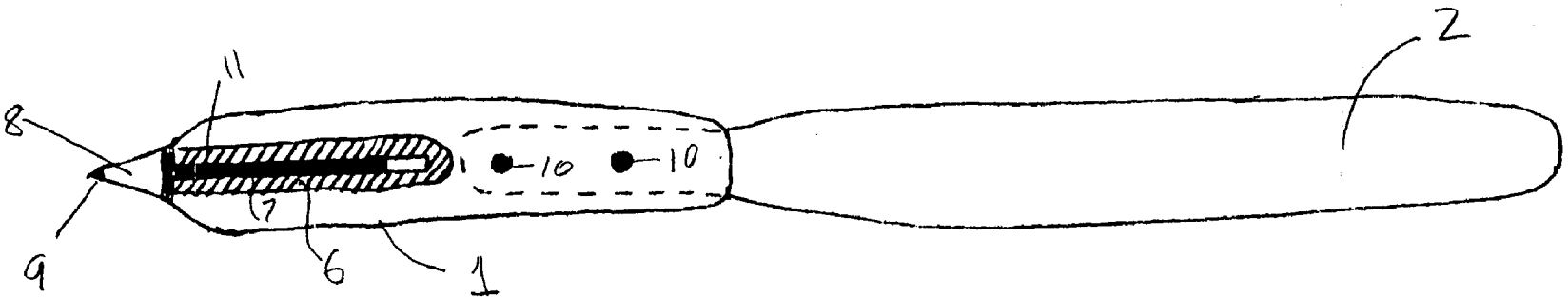
FIG. 2 is a similar view of the Invention looking down on the Invention so that the flat side of the blade is visible; the part of the blade in the handle is shown in phantom, as well as the pen chamber in the handle, containing the pen refill tube.

FIG. 2 is a top view looking down on the blade 2 the left end of which is shown in phantom inside handle 1, and is held in place by two screws, the screw heads 10 of which are shown. Also shown in phantom is the pen chamber 6 containing pen refill tube 7 and ink 11. At the far end of the Figure, pen tip fitting 8 is shown, through which pen tip 9 protrudes.

Figure 3:
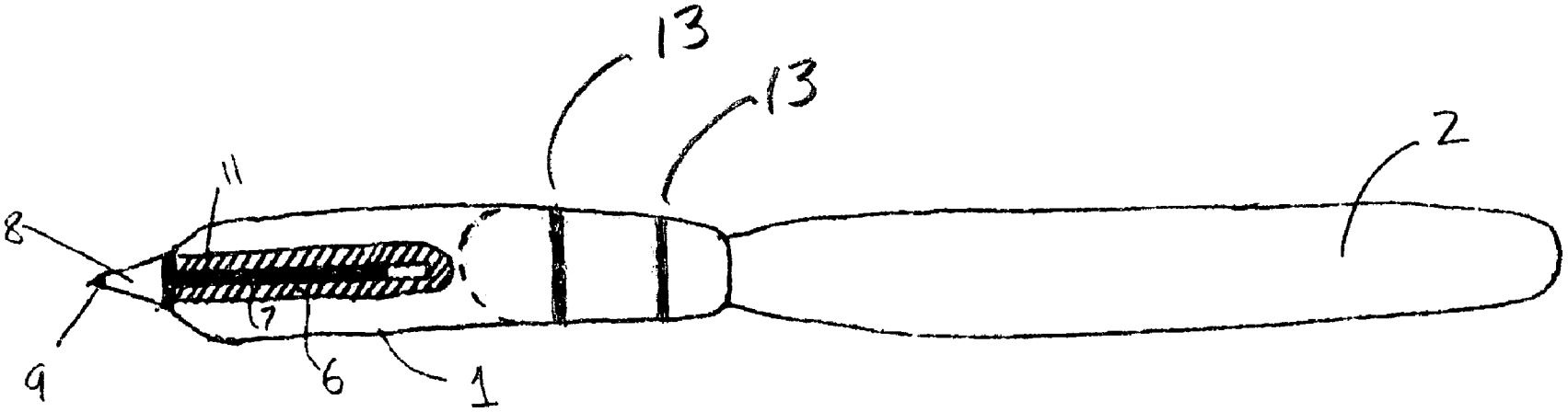
FIG. 3 is similar to FIG. 2 and shows bands holding the blade 2 in the handle slit.

FIG. 3 shows bands 13 holding blade 2 in the handle slit 12 (not shown).

DESCRIPTION—PREFERRED EMBODIMENT

In the preferred embodiment of the Invention the handle portion would typically be made of wood, and the blade of the spatula would be elongated and flat with a rounded end or rounded corners and made of metal and held in place in a slit in the wooden handle by one or more screws. The writing instrument of the Invention would preferably be a ballpoint pen refill tube, which can easily be replaced, and which is always ready and available for writing because the ballpoint pin tip is always exposed. The blade would be essentially flat and thin and flexible. It would have an elongated shape with a rounded end or two rounded exposed corners.

OPERATION OF THE INVENTION

The Invention can be used by pharmacists to increase their efficiency and to avoid wasting time looking for a writing instrument if they are using a spatula, and conversely looking for a spatula if they are using a writing instrument. The combination spatula and writing instrument can always be kept in a pocket of the pharmacist and is readily available to perform either function. Because of its size and shape and light weight, the pharmacist can almost instantly switch between a spatula and writing instrument by flipping the Invention in his hand. In the ballpoint version of the Invention, the writing instrument is always available because the tip of the ballpoint is always exposed and ready for writing. The blade of the spatula which could be either metal or plastic is sized and shaped to allow the pharmacist to easily count, manipulate, sort, etc. pills and capsules. The wooden portion of the Invention which functions as the spatula handle is also easily grasped by the pharmacist's hand when a writing instrument is needed. The Invention is designed to allow the ballpoint pen refill tube to be readily replaced. The Invention can be used for cleaning up powder or broken pills or capsules, or for mixing creams, pastes, powders, etc. to formulate prescriptions.

Tests

The spatula can perform quite well in actual practice. Most calls from doctors for new prescriptions happen when the pharmacist is in the pill counting process. The spatula can to be an excellent time-saving device which also saves physicians from holding on the telephone for a long time while the pharmacist searches for a pen to record the prescription. The Inventor allowed two pharmacists to test the device, and both requested one for personal use and were very impressed by its special utility to pharmacists.

Additional Embodiments

The spatula blade could be substantially flexible yet it retains its shape when not subjected to pressure or contact with other objects.

The length of the spatula blade and the length of the handle could vary according to the hand size of the user and personal preferences. A typical device would be about 11 inches in total length and about 1/16 inches thick or less, with the blade portion about 4-5 inches long, and the handle about 5 inches long with the pen tip and pen tip fitting extending about ¾ inch beyond the end of the handle. Other writing instruments could be used inside the handle including a mechanical pencil, ink marker, or other types of writing instruments. The writing instrument could be held in the handle by friction, screw threads or other means known to those skilled in the art to make it removable and refillable. The Invention could have different handle lengths and different pen chamber sizes. The Invention could accommodate a regular pen within the handle chamber, instead of just a pen refill. The blade attachment means for attaching the blade to the handle could include molding or stamping as one piece, brazing or welding the blade to the handle, or insertion of the blade into a slit in the handle and use of screws or brads, or use of bands around the handle and slit

Alternative Embodiments

Variations on the Invention would include handles with somewhat different shapes and surface textures to facilitate gripping by the hand. In addition to wood, other materials such as various plastics or metal could be used for the handle. The spatula blade could also be made from certain strong plastics or rubber in addition to metal. The metal blade could be attached by other means to the handle. In the case of plastics or rubber, the handle and the blade could be molded or stamped as one piece. If both the handle and blade were metal, the blade could be welded or brazed onto the handle. If the handle is wood or plastic and contains a slit into which the end of the blade fits, the blade could be held in the handle by means of brads going through the blade and handle, or by metal bands placed around the blade and handle. Conceivably the pen chamber could be made large enough to accommodate an entire pen or writing instrument, in which case the handle of the Invention would be very short, and the whole pen or pencil would function as a handle for gripping the Invention.

CONCLUSIONS, RAMIFICATIONS AND SCOPE

A number of changes are possible to the parts and materials described above while still remaining within the scope and spirit of the Invention. The specifics about the form of the Invention described in this application are not intended to be limiting in scope. The scope of the Invention is to be determined by the claims and their legal equivalents, not the examples given above.

I claim:

1. A combination of writing instrument and spatula of special utility to pharmacists and others, comprising:

(a) a handle containing a writing instrument at one end thereof, and (b) a substantially flat elongated spatula blade having an end inserted into the opposite end of said handle and attached to the handle by blade attachment means wherein the length of the blade is at least three times its width, wherein the blade is not pivoted with respect to the handle, and wherein an exposed portion of the blade is longer than the handle.

2. The device of claim 1, wherein the spatula blade is attached to the handle by insertion of an end into a handle slit in the handle and is held in the slit by one or more screws and nuts or brads which penetrate the handle and blade, or by bands which extend around the handle.

3. The device of claim 1, wherein the long axes of the handle and the spatula blade substantially coincide.

4. The device of claim 3, wherein the spatula blade is attached to the handle by insertion of an end of the blade into a handle slit in the handle and is held in the slit by one or more screws and nuts, or brads, which penetrate the handle and blade, or by bands which extend around the handle.

5. A combination of writing instrument and spatula of special utility to pharmacists and others, comprising:

(a) a handle containing a writing instrument at one end thereof, and (b) a substantially flat elongated spatula blade having an end inserted into the opposite end of said handle and attached to the handle wherein an length of the blade is at least three times its width, wherein the blade is not pivoted with respect to the handle, and wherein an exposed portion of the blade is longer than the handle.

* * * * *